United States Patent [19]

Romine

[11] Patent Number: 4,862,664

[45] Date of Patent: Sep. 5, 1989

[54] ROOFING FASTENER FOR FASTENER ASSEMBLY AND ROOF ASSEMBLIES

[76] Inventor: Robert L. Romine, 6266 Appleman Rd. SE., Newark, Ohio 43055

[21] Appl. No.: 137,071

[22] Filed: Dec. 23, 1987

[51] Int. Cl.[4] ..... E04B 5/00

[52] U.S. Cl. ..... 52/410; 411/387; 411/383; 411/910

[58] Field of Search ..... 52/410; 411/387, 383, 411/910

[56] References Cited

U.S. PATENT DOCUMENTS

| | | | |
|---|---|---|---|
| 4,074,501 | 2/1978 | Sandquist | 52/410 |
| 4,361,997 | 12/1982 | De Caro | 52/410 |
| 4,380,413 | 4/1983 | Dewey | 52/410 |
| 4,517,776 | 5/1985 | Barker | 52/409 |
| 4,545,270 | 10/1985 | Dewey | 81/429 |
| 4,601,625 | 7/1986 | Ernst | 411/387 |
| 4,621,963 | 11/1986 | Reinwall | 411/369 |
| 4,642,012 | 2/1987 | Blucher | 411/371 |
| 4,655,656 | 4/1987 | Jonsson | 411/337 |
| 4,757,661 | 7/1988 | Hasan | 52/410 |
| 4,762,453 | 8/1988 | De Caro | 411/383 |

FOREIGN PATENT DOCUMENTS

| | | | |
|---|---|---|---|
| 2711335 | 9/1978 | Fed. Rep. of Germany | 52/410 |
| 3040794 | 5/1981 | Fed. Rep. of Germany | 52/410 |

OTHER PUBLICATIONS

Trade Brochure (Portion)–Article on Atlas Roof Fastener Systems.

*Primary Examiner*—Henry E. Raduazo
*Attorney, Agent, or Firm*—Frank H. Foster

[57] ABSTRACT

A rotatably drivable roofing fastener of the invention of a synthetic-resinous-polymeric material, such as of an injection molded cut-glass-fiber filled nylon composition, includes means adapted for drillably cutting into insulation material during fastener installation and also means adapted to matingly engae a special tool providing rotatable driving while the tool also concurrently rotatably drives and matingly engages the head of a metal screw, which is located within an upper region of an aperture running lengthwise through the fastener's head and downwardly extending shank, so that the metal screw's threaded shank and tip extending from the aperature at the bottom of the fastener penetrates roof deck or existing roof structure upon rotatable driving so as to secure insulation material to roof deck or existing roof surface. Upon seating of the roofing fastener/metal screw and disengagement of the tool, a plug of insulating material is inserted into the aperture's upper region to provide fastener assemblies consisting essentially of the plug, the roofing fastener and the metal screw in the just-described relationship. A plurality of the fastener assemblies enable construction of roof assemblies, which in addition to roof deck, insulation material and fastener assemblies include an overlying exteriorly exposed waterproofing covering or membrane.

12 Claims, 3 Drawing Sheets

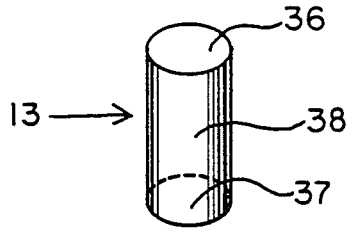
FIG. 6
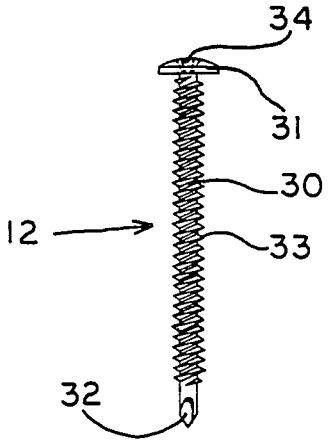
FIG. 5
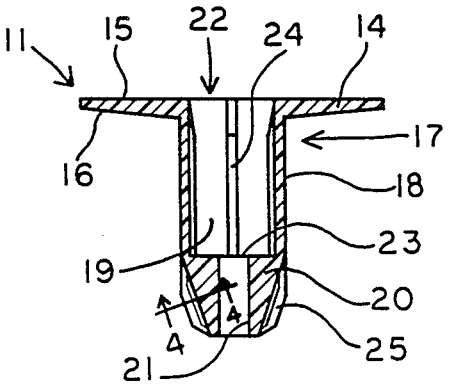
FIG. 1
FIG. 2
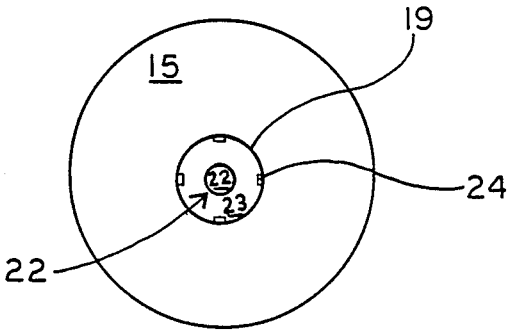
FIG. 3
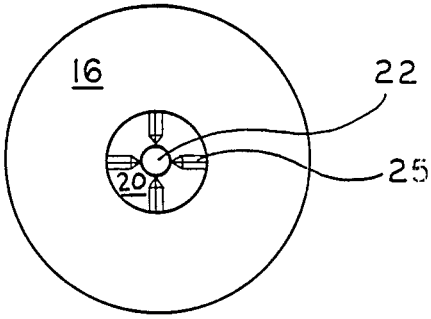
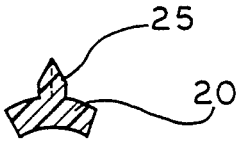
FIG. 4

ROOFING FASTENER FOR FASTENER ASSEMBLY AND ROOF ASSEMBLIES

This invention relates to a novel roofing fastener comprising with other components a fastener assembly for preparing roof assemblies as well as preparing of the roof assemblies including special tool(s) involved in the preparing. More particularly, the invention concerns roofing assemblies comprising a roof deck or existing roof surface overlaid with an insulation which in turn is overlaid with a waterproofing layer and securing of the insulation layer to the deck or existing roof surface by means of a fastener assembly comprising a self-tapping screw means and a roofing fastener of a synthetic-polymeric-resin material so adapted as to rotatably drill and be driven into and seated, while coupled with and concurrently rotatably driving the self-tapping screw means to seat itself with the screw means tapping into or through the deck.

BACKGROUND OF THE INVENTION

In the fastening of thermal insulation materials to roof decks for roof assemblies of various buildings, one encounters a number of problems, whether the installation be a retrofit or new installation. Frequently mechanical fastener means or assemblies are used, such as screws with stress-distributing washers and the like. Where the screws are of metal or of a material readily conductive of cold or heat, even if the head of such screw be covered by a waterproofing membrane, exterior and environmental temperatures are conducted by the metallic screw along its length from head to tip. Where the screw tip has penetrated , such as by a self-tapping screw through a metal deck component, so that the screw's tip is exposed to the interior of a building, there have been encountered corrosion problems in the vicinity of metal deck penetration in that humidities within the building and a tip about as cold as the screw head has led to moisture condensation on the screw portion projecting interiorly in the building. In some instances, this moisture condensation has been so great that water drips from the exposed screw's tip. Where 'plastic' fasteners are employed, heat and cold conduction problems and great temperature differences are avoidable, but in their installation it invariably is necessary to predrill a hole for the plastic fastener in roof decks of metal, wood, etc., which the plastic fastener can not readily penetrate. Another problem encountered with installed roof insulation material, and particularly in roof assemblies wherein an insulation material layer thereof be compressible, occurs, when, for example, a person walks thereon and is what is called fastener "pop". In such roof assemblies invariably the head of a fastening screw, e.g. a self-tapping screw, lies somewhere near the exterior surface of the roof assembly and the screw's tip is anchored in the roof deck (e.g. sheet metal). Upon pressure on the roof, such as a person's step on, or adjacent to, an installed screw, the roof's insulation yields and compresses, while the head of the screw does not yield, but instead the head "pops" or causes a rupture, or at least an upward dimple, in the roof's overlying waterproofing membrane or cover layer. Where the roof's insulation component be resilient and recovers to its original thickness upon removal of the pressure on the roof, the screw's head may again now be in its original position, but damage has occurred already of a leaky roof where waterproofing overcoating or membrane has been ruptured because of the screw's head "pop", or of a weakening of the overcoating membrane at the pop's dimpling location and with continued roof traffic resulting in a shortening of roof life in that dimpling stresses from fastener's head "pop" by successively encountered and eventually causes rupture and roof leaking.

The present invention advantageously overcomes and provides useful solutions to the just-mentioned problems and other problems encountered in roof assemblies. Additionally, other advantages are provided by the invention such as easy and rapid installation of roof assemblies involving insulation material overlying roof deck. One notable advantage of the invention is a providing of roof assemblies comprising a plurality of the invention's fastener assemblies, mechanically securing insulation material, and an installed overlying waterproofing membrane of so smooth an appearance as to make locations of the fastener assemblies visibly nondetectable by absence in the membrane of noticeable "imprint" or unevenness pinpointing fastener locations.

SUMMARY STATEMENT OF THE INVENTION

The invention provides a roofing fastener for securing a thermal insulation material to a roof deck by employing the fastener with a metal screw comprised of a threaded shank with a tip, preferably self-tapping, at one end and at the other end a head adapted for a mating or coupled engagement with a tool means for rotatably driving the screw. The roofing fastener comprises: a head; a shank component, integrally joined to the head and projecting generally downward from the head; with the head characterized by having a flat upper surface and a generally smooth lower surface tapering inwardly from its outer edge to a greater thickness at a central region whereat it merges with an upper portion, which projects generally perpendicularly downward, of the shank component. In additional characterization, the fastener includes a centrally located aperture extending lengthwise through the shank component and the head with the aperture comprising a lower region of a suitable size adapted to accommodate the screw's threaded shank and not accommodate the screw's head and an upper region of a suitable size adapted to accommodate and seat the screw's head while providing a boundary surface contour adapted for a mating or coupled engagement with the tool means so as to permit and provide concurrently rotatable driving of both the fastener and the screw. In still additional characterization, the fastener's shank component includes on its lower portion an exterior surface contour adapted to provide a plurality of projecting flutes with cutting edges adapted to function as a drill bit upon rotatably driving of the fastener. In a particular fastener embodiment, the plurality of flutes and cutting edges are adapted to cut by drilling a hole of a size accommodating the shank component of the fastener. The roofing fastener is fabricated, generally by molding, from a synthetic polymeric resinous molding composition or other "plastic" molding composition, such as from a preferred injecting molding composition of a cut-glass-fiber filled nylon molding composition, so as to possess adequate strength and durability in its flutes and cutting edges adapted to drill into a thermal insulation material, such as a closed-cell foamed insulation material, fiber glass board, wood fiber board, gypsum board, perlite board, tectum board expanded polystyrene beadboard, fesco board, foamed-expanded polyisocyanurate and/or polyurethane sheets, panels, etc., and the like. The plastic material for fabrication of the fastener, as well as the fastener's flutes and cutting edges, generally are adapted to drill into and through facing materials on the aforementioned insulation materials as well as numerous waterproofing membranes, such as EPDM, HYPALON® rubber, PVC, CPE, modified bitumen, BUR and similar materials.

The fastener assembly of the invention consists essentially of combination of the just-described roofing fastener and metal screw with a plug of a compressible, resilient insulating material positioned in the upper region of the fastener's aperture above the metal screw which is seated in the upper region, and has the screw's tip and a portion of its threaded shank in and/or extending through the roof deck. In installed relationship with a roof assembly, the fastener assembly, as installed, secures the insulation material to the roof deck and in some embodiments waterproofing membrane also is secured at the same time.

In a desirable "single ply" roof assembly installation, for example, fastener assemblies secure a layer of insulation material and in some applications roofing membrane, to a roof deck by the installed fastener assemblies having their roofing fasteners located in the insulation material and roofing membrane with the top surface of the heads of the fasteners flush or about flush with the top of the insulation material or roofing membrane and with the screw's tip and at least a portion of the screw's threaded shank in or projecting through the bottom of the roof deck, which frequently is of sheet metal in a fluted or convoluted conformation. In this "single ply" roof assembly, the installed fastener assemblies are overlaid with a lapped-over waterproofing membrane. In other embodiments of roof assemblies employing the fastener assembly of the invention, additional layers of various known materials in various combinations may be included below an exteriorly exposed waterproofing covering or membrane and yet overlying a layer of insulation material which rests upon a roof deck material.

For utilization of the roofing fastener so that it be installed as a part of a roof assembly, the invention includes rotatable driven tools and also includes these tools as utilized, for example, such as in combination with the roofing fastener/metal screw for their installing. One important rotatable drive tool comprises: a central shaft having at one end a means adapted for coupling engagement to a rotatable driving means and at the other end a tip for matingly engaging and coupling to the head of the metal screw; and a cylindrical component encircling the central shaft with this component adapted so as to be coupled and secured to the tool's central shaft at a desired location thereof and also adapted so that its exterior matingly engages and couples to the boundary surface contour of the upper region of the roofing fastener's aperture; whereby driving rotation of the tool when so matingly engaged provides a concurrently driving rotational movement of both the roofing fastener and the metal screw whose head is in the upper region of the fastener's aperture. Another useful special tool permits the forming by drilling of a recess hole for the roofing fastener in a material, such as plywood, wafer or pressed wood-chip board, and the like, which is not readily susceptible to a direct driving rotatable installation of the roofing fastener/metal screw. This special tool also comprises: a central shaft, although its central shaft has a drill tip and includes drill cutting flutes; and a cylindrical component encircling the central shaft and able to be secured thereto; although this cylindrical component includes on its exterior bottom portion a plurality of radial cutting blades adapted to cut or mill material so as to create a recess for the head of the roofing fastener.

BRIEF DESCRIPTION OF THE DRAWINGS

FIG. 1 is a lengthwise cross-sectional view of a synthetic-polymeric-resin roofing fastener employed in the fastener assembly of the invention;

FIG. 2 is a top view of the synthetic-polymeric-resin roofing fastener;

FIG. 3 is a bottom view of the synthetic-resin roofing fastener;

FIG. 4 is an enlarged cross sectional view taken along line 4—4 in FIG. 1;

FIG. 5 is a perspective view of a threaded self-tapping metal screw employable with the roofing fastener in the fastener assembly of the invention;

FIG. 6 is a perspective view of a compressible insulating plug employable with the screw and the roofing fastener in the fastener assembly of the invention;

Figure 7:
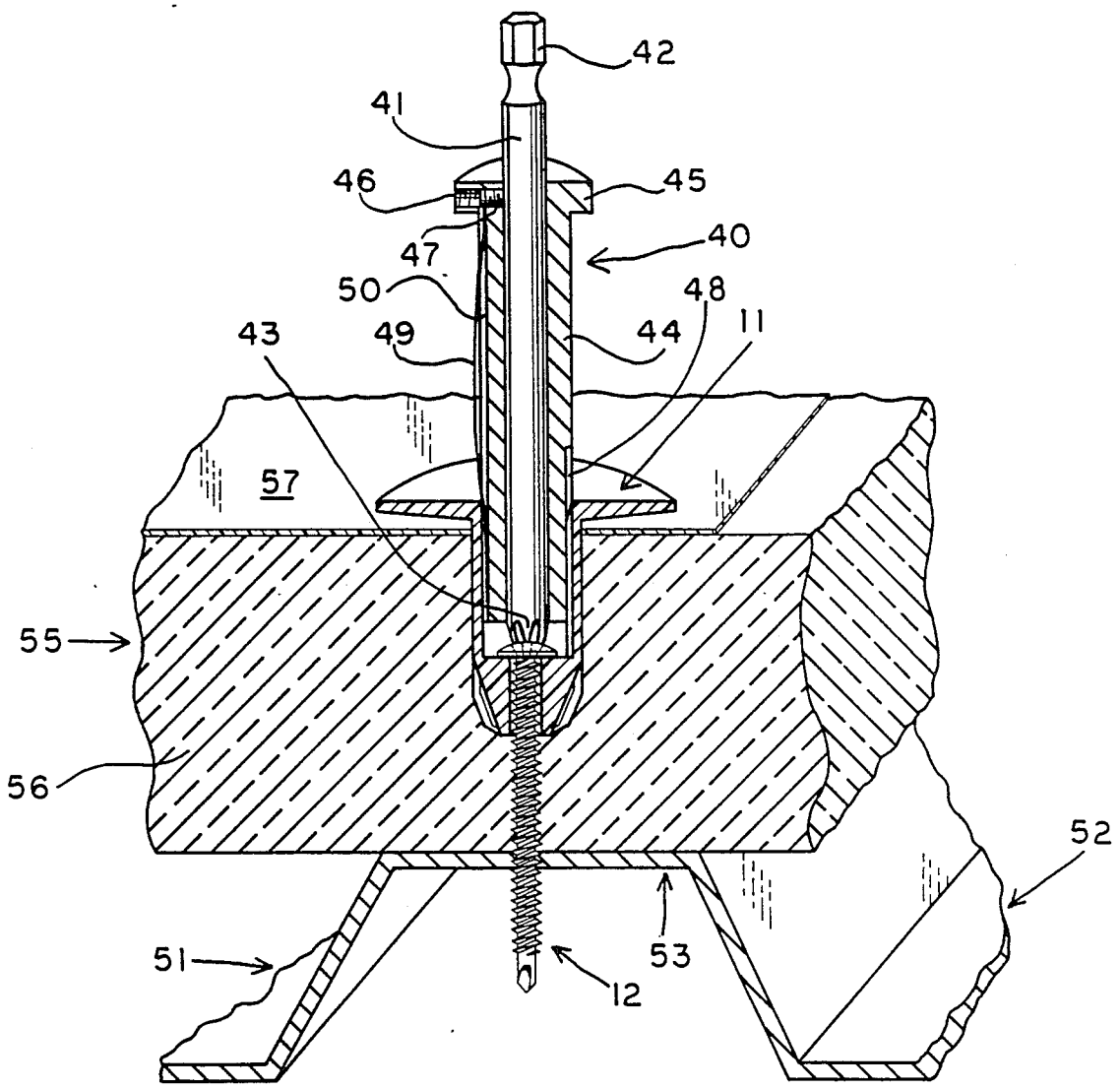
FIG. 7 is an in-part perspective view broken away to provide cross-sectional views of portions of the fastener assembly and a roof assembly of the invention at an intermediate stage of preparation of the finished roof assembly with a rotatable tool of the invention in engagement with both the screw and the roofing fastener.

In the drawing figures, the same reference number throughout is used for illustrative purposes for the same feature and/or element or component where feasible. In the drawing figures, various features, elements and components are not necessarily drawn to true scale and proportion with presented scale, proportion, and relationship of the elements and components being illustrative only and those of import and utility being clear from description which follows.

DETAILED DESCRIPTION OF PREFERRED EMBODIMENTS

With reference to the drawing figures, the invention includes the combination comprising a roofing fastener, generally designated 11, of a synthetic-resinous-polymeric material, a self-tapping screw means, generally designated 12, of metal, and a plug, generally designated 13, of a compressible insulating material.

The roofing fastener 11 includes a head 14 having a flat upper surface 15 and a lower smooth surface 16 tapering in thickness from an outer circular peripheral edge to a thicker thickness at its inner region whereat it merges with a shank, generally designated 17. The shank 17 projects generally perpendicularly downward from the head 14 and an upper portion thereof, whose shape is generally tubular, includes an exterior wall surface 18 and an inner wall surface 19. The shank 17 from its upper portion merges into a lower portion, whose exterior shape is generally of a tapered downwardly truncated conical configuration, including an exterior wall surface 20 and an inner wall surface 21. The roofing fastener 11 includes a centrally located aperture 22 extending through the head 14 and shank 17 with an upper aperture region bounded by the inner wall surface 19 of the upper portion of the shank 17 and a lower aperture region bounded by the inner wall surface 21 of the lower portion of the shank 17 with the upper and lower regions together comprising the centrally located aperture 22. The upper aperture region can be deemed a recess in fastener 11 in that at an appropriate distance downward from flat upper surface 15 the aperture or recess abruptly constricts inwardly to a smaller cross-sectional size lower aperture region extending downwardly in the fastener 11 to open at the bottom of the lowermost portion of shank 17. At the point of constriction of upper aperture region to lower aperture region, the constriction provides a flat ring-like planar surface functioning as seat 23 for subsequently installed screw means 12.

Of import to fastener 11 is that inner wall surface 19 of the so-called recess of aperture 22 be of a contour adapted for mating or coupling engagement with a driving means of a driving tool for rotatably driving fastener 11. In the embodiment of fastener 11 illustrated in FIG. 1, the inner wall surface includes a plurality of downwardly extended projecting ridges 24, which near upper surface 14 advantageously taper towards the periphery of aperture 22 in upper surface 15 so to facilitate entry of the driving means for its mating engagement.

Of import to fastener 11 is that exterior wall surface 20 of the lower portion of shank 17 be of a contour including a plurality of flutes 25 of a configuration such as to be adapted to function as cutting flutes, similar to a drill's flutes, so as upon rotatable movement thereof flutes 25 drill and cut material permitting ingress of the shank 17 into a hollow cut in material by the flutes 25. In the embodiment of the fastener 11 illustrated in FIG. 1, the flutes 25 in cross-section are of a triangular-like configuration including cutting edges comprised of a sharp corner of the triangular-like configuration extending outwardly from the exterior surface of the tapering downwardly truncated conical configurational contour of the lower portion of shank 17. As can be noted from the embodiment in FIG. 1, cutting edges of flutes 25 also advantageously extend at their uppermost end to a position adapted so as to enable cutting a hole in the material about equivalent in its cross-sectional size of that accommodating the upper portion shank 17, and also cutting edges of the flutes 25 near their termination at the bottom of shank 17 advantageously taper toward the bottom opening of aperture 22 so as to cooperate with the self-tapping screw means 12 in cutting a hole in the material.

The embodiment of a self-tapping screw means 12 illustrated in FIG. 5 comprises an elongated shank 30 with a driving head 31 formed on one end and a drilling tip 32 on the other end. The shank 30 includes a thread 33 adjacent its tip 32 and extending spirally upward on shank 30 and so adapted and of a distance upward such as to enable anchoring of screw means to material into which tip 32 and thread 33 have been rotatably downwardly driven. Included in head 31, as illustrated in FIG. 5, are recesses 34, exemplary for mating engagement of the tip of a phillips-head rotatable driving means. In other useful embodiments (not illustrated) of screw means 12, its contemplated head 31 may be of any of many known useful shapes and configurations suitable for engagement and adapted to be rotatably driven and seated by a rotating driving means. For example, (not illustrated) are various heads which may be of enlarged hex-shape configurations, heads having engageable recesses therein other than for phillips-head driving means, such recesses as slots, star-shapes, Allen-wrench socket-shaped recesses, etc., as well as other head engagement means known to the art for purposes of being rotatably driven and seated by known screw driving means.

FIG. 6 illustrates a useful element of a plug 13 of a compressible insulating material. As shown, plug 13 is of a cylindrical shape comprising a top 36, a bottom 37, a side wall 38. The size and contour of plug 13 is adapted such that under slight compression it can be inserted into the upper region of aperture 22 and upon removal of compression it seeks to return to its original size so as to effectively fill and engage wall 19 of aperture 22 when head 31 of screw means 12 is seated against seat 23 of roofing fastener 11. In an installed fastener assembly of the invention, the plug 13 provides significant useful contributions. Plug 13 while positioned in the upper region of aperture 22 serves as a thermal insulation of screw means 12 from exterior environmental temperatures and thus avoids and/or aids elimination of significant corrosion problems and condensed moisture drips. Plug 13 also, while so installed, serves as an upper cushion or the like for the head 31 of screw means 12 when pressures on the roof assembly are such that otherwise head "pop" damage would occur and thus the plug minimizes and/or prevents "pop" damages.

In FIG. 7, the roofing fastener 11 and screw means 12 are depicted in a partially installed position along with a rotatable tool means, generally designated 40, in mating or coupled engagement with screw means 12, particularly in engagement with recesses 34 in its head 31, and in mating or coupled engagement with roofing fastener 11, particularly in engagement with ridges 24 of inner wall surface 19 in the upper portion of its aperture 22. The combination of the tool means 40 and screw means 12 and roofing fastener 11 are shown with the fastener 11 and screw means 12 penetrated to a large extent, but not fully penetrated and seated, as in a final installation, into a skin-surfaced insulation layer 56 and deck means 51. In FIG. 7, the illustrated deck means 51 comprises a sheet metal fluted configuration with a plurality of parallel running channels 52 and flutes 53. Abutting the top surface of a flute of deck means 51 is an insulating composite generally designated 55, whose main section is composed of a cellular compressible insulation layer 56, such as a compressible cellular polyisocyanurate material, overlaid with a single-ply waterproofing roofing membrane 57, such as chlorosulfonated polyethylene sheeting (e.g. *HYPALON*® material).

With reference to fastener assembly installation, the rotatable tool means 40 comprises a centrally located generally cylindrical shaft 41, which at its upper end includes a driving means 42, as illustrated, a hex-shaped head, adapted for drivable engagement with a chuck (not illustrated) of a power-driven screw-driver or drill means (not illustrated). Shaft 41 at its lower end is in a configuration of a phillips-type tip 43 for coupling engagement with the recesses 34 in the head 31 of screw means 12. Encircling shaft 41, and in an adjustable slidable engagement therewith, is a tubular component 44 whose upper end includes an integral enlarged ring 45 having radially therethrough a threaded aperture 46 which contains a sunken set screw 47 which is in tightened engagement with shaft 41 so that when shaft 41 is rotated then tubular component 44 also rotates. By loosening set screw 47, sliding tubular component 44, and then retightening screw 47, tubular component 44 may be repositioned so that tool means 40 can be used with a range of sizes of roofing fasteners 11, whose depth of upper region may differ depending on design requirements for various roof assemblies. In a not illustrated embodiment of tool means 40, threaded aperture 46 and set screw 47 are eliminated with shaft 41 and tubular component 44 of such a size and fit that they are adapted to be press-fitted into a desired fixed engagement so that together they rotatably drive upon rotatable driving of driving means 42. The lower portion of tubular component 44 in its exterior surface includes a plurality of grooves 48 correspondingly matching projecting ridges 24 of roofing fastener 11 so as to couple or matingly engage the same for rotatably driving roofing fastener 11 when tool 40 is rotatably driven. Tool means 40, as illustrated, includes an outwardly bowed spring element 49, such as a strip or wire, which at one end is anchored into a small hole in ring 45 and then extends therefrom downwardly along the exterior of shaft 41 to a distance that a portion of the length of the spring element 49 contacts inner wall surface 19 of roofing fastener 11. The lower tip of spring element 49 rests in a lengthwise groove 50 which runs along component 44 downwardly from where spring element 49 is anchored into ring 45. Through this contacting of the spring element 49, when tool means 40 is coupled by its driving means 42 to a chuck (not illustrated) of a (not illustrated) power-driven rotatable driving means, such as a power screw-driver, it is advantageously possible to lead the tool means 40 with a roofing fastener 11 containing in its central aperture 22 a self-tapping screw means 12 so that the overall loaded assembly of the two can be moved around without fastener 11 and screw means 12 falling off or disengaging from tool means 40. Yet once the, not illustrated, rotatable driving means has been activated and the fastener 11 and screw means 12 fully seated and installed in a roof assembly, the tension of the bowed spring element is light enough against inner wall surface 19, that tool means 40 can be disengaged from its coupled arrangement with fastener 11 and screw means 12, while they remain seated, and is ready to be "re-loaded" with another fastener 11 and screw means 12 and moved to its next location for another installation by the rotatable driving means.

Figure 8:
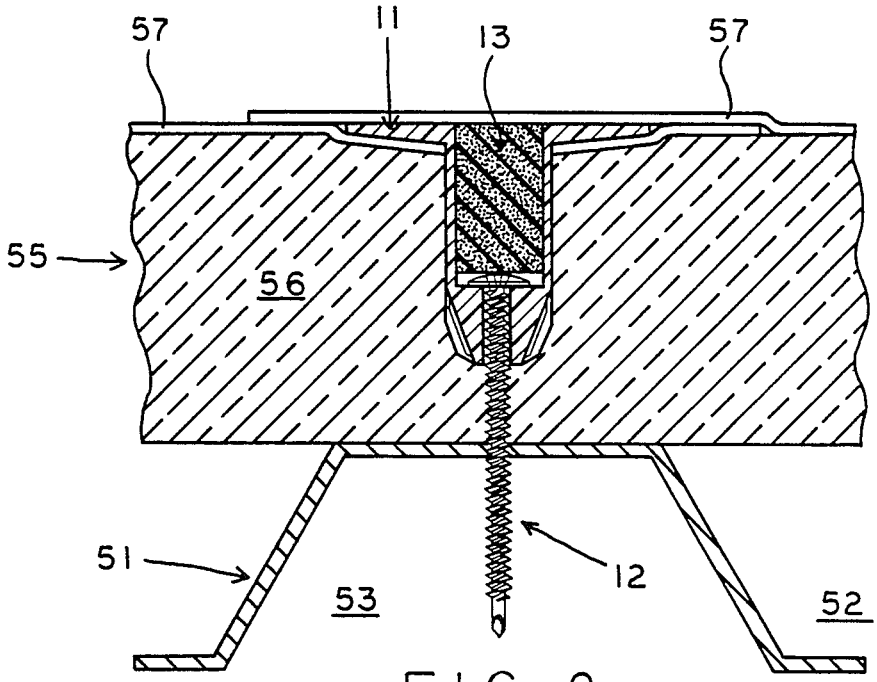
FIG. 8 illustrates in cross-sectional view one embodiment of a roof assembly of the invention.
Figure 9:
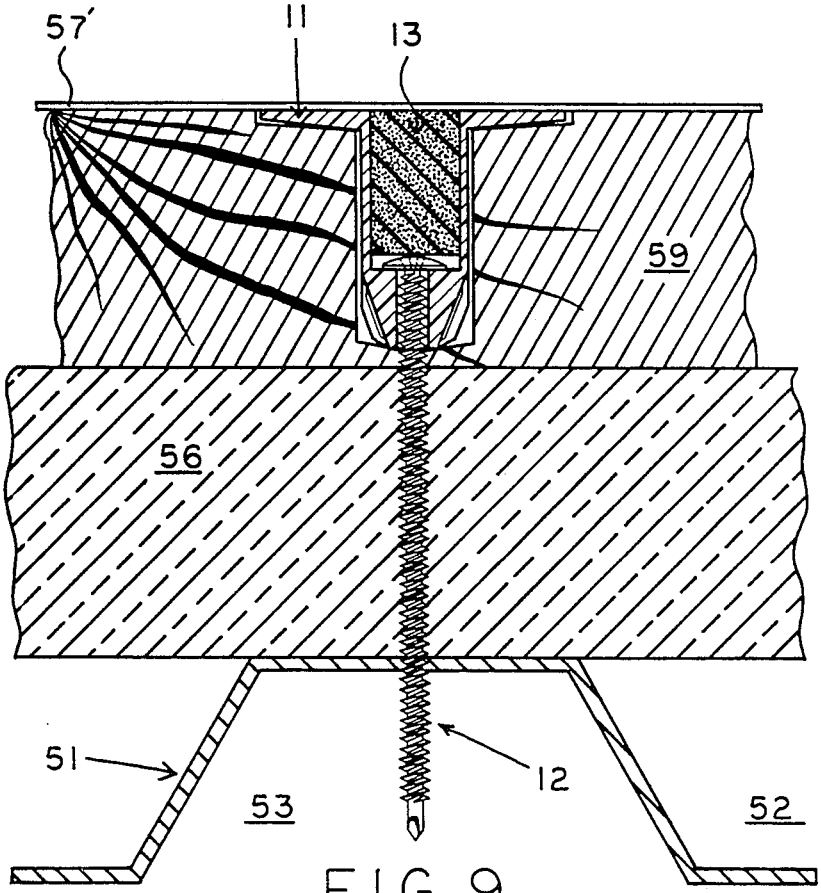
FIG. 9 illustrates in cross-sectional view another roof assembly embodiment of the invention.

Two exemplary illustrative embodiments of the invention are depicted in FIGS. 8 and 9, respectively. In each, the deck means 51 illustrated is that of a sheet metal fluted configuration, such as also shown in FIG. 7. Such a deck means 51 would be anchored to conventional roof structural elements (not illustrated) by conventional known anchoring means (not illustrated). Alternatively and not illustrated, in place of the illustrated sheet metal fluted-configuration for the deck means 51, useful deck means for roof assemblies of the invention can be of any of numerous useful conventional deck means, for example, such as corrugated metal panels, wood, plywood, wooden chipboard, various composition surfaces including hardened fibrous-reinforced gypsum, hardened light-weight cement, cement containing perlite, asphalt, granule-surfaced asphalt, or like conventional deck means, including deck means comprising various multi-layered components. Contemplated useful deck means include not only those for new construction, but deck means already installed, with or without surface modification thereof as required, and with retrofit applications of insulation material thereon employing waterproofing membrane and fastener assemblies of the invention for securing insulation material to the already installed deck means.

The roofing assembly in FIG. 8 depicts what is called a single-ply roof assembly. In this installation, the deck means 51 is overlaid with an insulation layer 56. While the insulation layer 56 depicted is that of a cellular compressible material; such as provided by known cured foamed isocyanate-urethane conventional compositions, which may or may not have unitary skin-like surfaces, other insulating materials may serve as a useful insulating layer 56. Regarding insulation layer 56, although the present invention is especially advantageously employed with cellular compressible and resilient insulating materials, the invention encompasses embodiments using relatively non-compressible and non-resilient insulating material, for example, cellular polystyrene panel and the like. Other contemplated insulation layers include tightly compressed resin/glass fiber batting and panels, fiber glass board, wood fiber board, gypsum board, perlite board, tectum board expanded polystyrene beadboard, fesco board, foamed-expanded polyisocyanurate and/or polyurethane sheets, panels, etc., foil and/or other skin surfaced embodiments of such insulation materials as well as various multi-layered composites thereof including those being newly installed as well as those of existing constructions.

For preparation of the roofing assembly embodiment illustrated in FIG. 8, insulation layer 56 is placed on top of deck means 51 and a conventional roll of membrane 57 or sheeting of a water-proofing material is unrolled for subsequent securing or mechanically fastening by the invention's fastener assembly to the upper surface of insulation layer 56. In some embodiments, the membrane may be adhesively secured to the upper surface. Tool means 40 is loaded with a roof fastener 11 containing screw means 12 within aperture 22. Then at an appropriate position near the running edge of membrane 57, the (not illustrated) power-driven rotating power means is activated with the tool means 11 rotating the coupled fastener 11 and screw means 12 to drill them into the membrane 57/deck means 51 assembly until the upper surface 15 of the head 14 of fastener 11 is seated flush with, or approximately at the same level of, the membrane 57. Thereupon the tool means 40 is withdrawn from the seated coupled roof fastener 11/screw means 12 and a plug 13 placed in the upper portion of aperture 22 with the top 36 of plug 13 being flush or about level with the membrane 57. The loading of tool means 40 with fastener 11 and screw means 12 is repeated along with another installing of a fastener 11/screw means 12, followed by insertion of a plug 13 until a requisite number of fastener assemblies have been installed at requisite locations. Thereafter, additional membrane 57 or sheeting is applied with an overlapping and sealing of newly applied membrane over that portion of the earlier applied membrane having installed fastener assemblies therein. Sealing of the overlap may be by known means, such as by adhesives, flame or hot air welding of thermoplastic membrane, or other known means.

Of significant importance to the preparation of the single-ply roofing assembly depicted in FIG. 8 is that there is no need to pre-drill any hole or recesses for fastener 11/screw means 12 and that during their installation the fastener 11/screw means 12 drill and cut in membrane 57 and in insulation layer 56, and screw means 12 in deck means 51 the requisite hold(s) for their final installed and seated positioning comprising a roof assembly. No recess hole need be drilled for head 15 of roofing fastener 11. Advantageously, the lower surface 16 of head 15 of roofing fastener 11, when installed in the FIG. 8 embodiment, is seated by being pulled downward towards insulation layer 56, which compresses slightly to form a tight seal with the head 15.

The roofing assembly depicted in FIG. 9 is another embodiment of a roof assembly fabricated with the fastener assembly of the invention. While this particularly illustrated embodiment may not provide all of the advantages for installation as that of FIG. 8, it still is highly useful and possesses advantages over known roof assemblies. The FIG. 9 illustrative roof assembly, akin that of FIG. 8, includes a deck means 51, an insulation layer 56, a roofing fastener 11, a screw means 12 and a plug 13. The illustrative FIG. 9 roof assembly on top of insulation layer 56 has a layer of wood 59, such as boards of wood per se, or plywood sheeting, or pressed chipboard panels, or the like. Overlying this layer of wood 59 and the installed fastener assembly, consisting essentially of roofing fastener 11, screw means 12 and plug 13, is shown a membrane 57' of a waterproofing composition. This membrane 57' is not, as 57 in FIG. 8's embodiment, an already formed sheet or the like that is applied and mechanically secured or adhered by adhesive, but instead 57' depicts a seamless monolithic membrane 57' formed by curing or setting of an applied fluid waterproofing coating composition applied and/or set or cured on site. Although not illustrated, prior to application of the composition providing membrane 57', there may be applied an appropriate primer coat, such as for example an acrylic prime coat, and/or there also may be laid a fabric, such as of glass fiber, spun polyester, nylon mesh, nonwoven polyester, etc., with the subsequently applied primer coat or formed membrane 57' incorporating therein and/or overlying such embedded fabric. Known to the art are useful waterproofing coating compositions for forming on-site a waterproofing membrane or requisite properties. A particularly useful membrane preparing on site includes applying an acrylic latex prime base or prime coat with a polyester fabric being embedded therein and followed by an applied fluid acrylic latex topcoat. Useful acrylic latex compositions are known with drying times of 2 to 10 hours per coat, in colors of white, tan or black, having solids contents by weight of about 65–66% and by volume of about 55%, and of about 10.5 lbs/gal. Other known useful fluid compositions for preparing the membrane on site are based on urethanes, polyvinylchloride resins, liquid HYPALON®, asphalt and/or bitumen emulsions and various synthetic resins and synthetic rubbers.

In the particular roofing assembly depicted in FIG. 9, it can be noted that directly underlying formed-on-site waterproofing membrane 57' there is a layer of wood 59 composition. Depending on the density, hardness and other properties of this layer of wood 59 and also the specific synthetic-resinous-polymeric material comprising roofing fastener 11, it may be desirable to predrill and/or cut into this layer of wood a recess adapted to receive the employed roofing fastener 11 before installing fastener 11/screw means 12. A particularly useful tool (not illustrated) for drilling in this wood, or other hard material not able to be or not easily drilled and cut by fastener 11, has been found to comprise a central shaft component having at its upper end a contour adapted for drivable engagement in the chuck (not illustrated) of a power driven drill means (not illustrated) or the like. The other or lower end of the central shaft includes the tapered cutting tip of a conventional drill bit and running upward from the tapered tip is the spiral cutting flute of a conventional drill bit. Desirably, the tapered tip of the central shaft component is of a tapered contour closely approximating that of the contour of the tapered hole that would be cut by cutting flutes 25 of fastener 11. This particularly useful tool, surrounding its centrally located drill shaft component, comprises an encircling ring-like cylindrical component which is adapted to be in slidable engagement with the shaft component and has radially therethrough a threaded aperture containing a sunken set screw. Thus, when the cylinder component is slidably positioned at a desired location on shaft component, the set screw may be and is tightened to lock or couple the cylindrical and shaft components together so that a rotatable driving of the one component drives the other. The underside of the ring component includes a plurality of radial cutting blades adapted with the ring component upon rotatable movement to drill or mill a recess in the layer of wood 59, which recess is of a size including desirably a tapered recess bottom adapted to receive and accommodate the tapered head 14 of roofing fastener 11.

Of import to roofing fastener 11 is that it be comprised of, and generally consists of essentially of, a synthetic-resinous polymeric material composition. Advantageously by being of a synthetic resinous polymeric material, the roofing fastener 11 possesses superior insulating properties upon exposure to the heat or cold of the exterior environment confronting the roof assembly in comparison to roofing fasteners of metal composition. A particularly and preferred synthetic-resinous polymeric material for roofing fastener 11 is an injection molding composition consisting essentially of nylon 66 containing about 30 percent by volume of cut glass fibers as filler. Other glass-filled molding compositions also are useful, as well as other plastic or synthetic-resinous polymeric compositions. A roofing fastener 11 injection-molded of a nylon 66/glass-fiber-filled material possesses on flutes 25 a cutting edge durable and sharp enough to enable drilling and cutting through and/or into roof assembly layers, such as membrane 57, compressible resilient and non-resilient insulation materials (such as "isocy-urethane" foamed sheets and panels, foamed polystyrene cellular panels, packed and densified resin-bonded glass-fiber batting, and the like), etc. Depending on the specifically employed insulation material layer 5, and/or membrane 57 layer, and/or other conventionally used insulating layers or composites for roof assemblies, it is contemplated without undue experimentation that one skilled in "plastics" art will be able to experimentally evaluate and select appropriate useful suitable synthetic-resinous polyeric materials to fabricate or mold into the requisite roofing fastener possessing a desired cutting and drilling capability upon rotatable movement thereof.

It will be apparent to those skilled in the art that numerous changes and improvements can be made in the preferred embodiments of the invention described above without departing from the scope of the invention. Thus, while the description herein has been of the fastener employed as a roofing fastener and the same included as a component in roofing fastener assemblies to make possible significantly improved roof assemblies, it will be apparent that other construction usages are possible and advantageous, for example, with the fastener and fastener assemblies employed for securing an insulation layer in sidewall construction whether the same be a new or retrofit installation. Accordingly, the foregoing description is to be construed in an illustrative and not in a limitative sense, with the true scope of the invention being defined solely by the appended claims.

I claim:

1. A roofing fastener for securing a thermal insulation material to a roof deck by employing therewith a metal screw comprised of a threaded shank with a self-tapping tip at one end and at the other end a head adapted for a coupled engagement with a tool means for rotatably driving of said screw, said fastener comprising:

a head;

a shank component integrally joined to said head and projecting generally downward from said head;

said head having a flat upper surface and a lower smooth surface tapering inwardly from its outer edge to a greater thickness at a central region whereat it merges with an upper portion, which projects generally perpendicularly downward, of the shank component;

said fastener including a centrally located aperture extending lengthwise through said shank component and said head with said aperture comprising a lower region of a size adapted to accommodate the threaded shank of said metal screw and comprising an upper region of a size adapted to accommodate the head of said metal screw with said upper region having a boundary surface contour adapted for coupling engagement with said tool means for rotatably driving said screw so as to permit concurrently rotatably driving of both said fastener and screw; and said shank component including on a lower portion thereof an exterior surface contour adapted to provide a plurality of projecting flutes with cutting edges adapted to function as a drill but upon driving rotation of said fastener.

2. The roofing fastener of claim 1 in which said flutes and cutting edges on said plurality of flutes are adapted to cut by drilling in said thermal insulation material of a hole of a size accommodating said upper portion of said shank component.

3. The roofing fastener of claim 2 which consists essentially of a synthetic polymeric resinous molded composition.

4. The roofing fastener of claim 3 in which the synthetic polymeric molded composition is a cut-glass-fiber filled injection molded nylon composition.

5. The roofing fastener of claim 3 installed and in combination with a roof assembly comprising:

(a) a roof deck;

(b) a layer of insulation material, which is compressible and resilient, overlying the roof deck;

(c) an exterior membrane, which is composed of a waterproofing composition; and (d) underneath said exterior membrane and securing said layer of insulation material to said roof deck, the roofing fastener of claim 3 in the combination of an installed fastener assembly comprising (i) said roofing fastener of claim 3, (ii) said metal screw, and (iii) a plug of compressible resilient insulating material with said (i), (ii) and (iii) of said installed fastener assembly installed in relationship as shown in FIG. 8 so as to secure said insulation material to said roof deck.

6. The roofing fastener of claim 3 in a combination comprising:

(1) said roofing fastener;

(2) said metal screw with said metal screw positioned in said aperture of said fastener and with said head of said screw in the upper region of said aperture and with the tip of said metal screw projecting from said aperture, at the lower end of said shank component; and (3) a rotatable tool means in combination with said roofing fastener and said metal screw with the rotatable tool means comprising (i) a rotatable central shaft having a terminal tip adapted to and coupled in mating engagement with the head of said metal screw providing for rotatably driving of said screw, and (ii) a generally cylindrical-like component encircling said central shaft and fixedly coupled thereto and having an exterior surface contour adapted to and coupled in mating engagement with said roofing fastener so that a drivable rotation of said shaft concurrently provides drivable rotation of said roofing fastener and said metal screw.

7. A fastener assembly comprised of the combination of:

(1) A metal screw comprising (a) a head, and (b) a threaded shank projecting downwardly from said head;

(2) a synthetic polymeric fastener component comprising (a) a head, (b) a shank component integrally joined to said head and projecting generally downward from said head, (c) said head having a flat upper surface and a lower smooth surface tapering inwardly from its outer edge to a greater thickness at a central region whereat it merges with an upper portion, which projects generally perpendicularly downward, of the shank component, (d) said fastener including a centrally located aperture running lengthwise through said shank component and said head with said aperture comprising a lower region of a size adapted to accommodate the threaded shank of the metal screw and comprising an upper region of a size adapted to accommodate the head of the metal screw and with said upper region having a boundary surface contour adapted for coupling engagement with a tool means for rotatably driving said head of the metal screw so as to permit concurrently rotatably driving of both said fastener component and said head of the metal screw, and (e) said shank component including on a lower portion thereof an exterior surface contour adapted to provide a plurality of cutting edges functioning as a drill bit upon driving rotation of said fastener component;

(3) a plug of compressible insulating material;

(4) said head of said screw located in and seated in the upper region of said aperture with the threaded shank of said screw in the lower region of said aperture and projecting therefrom; and (5) said plug positioned in the upper region of said fastener component and on top of said head of said screw.

8. A roof assembly which comprises:

(1) a roof deck;

(2) a layer of insulation material overlying said roof deck;

(3) an exteriorly exposed membrane providing waterproofing of said roof assembly;

(4) a plurality of roofing fastener assemblies installed and securing said layer of insulation material to said roof deck with said assemblies located underneath said membrane and with each roofing fastener assembly consisting essentially of (a) a synthetic polymer resinous molded roofing fastener, (b) a metal screw comprised of a threaded shank with a self-tapping tip at one end and at the other end a head adapted for a coupled engagement with a tool means for rotatably driving of said screw, and (c) a plug of resilient compressible insulating material, and with said roofing fastener comprising:

a head, a shank component integrally joined to said head and projecting generally downward from said head, said head having a flat upper surface and a lower smooth surface tapering inwardly from its outer edge to a greater thickness at a central region whereat it merges with an upper portion, which projects generally perpendicularly downward, of the shank component, said fastener including a centrally located aperture extending lengthwise through said shank component and said head with said aperture comprising a lower region of a size adapted to accommodate the threaded shank of said metal screw and comprising an upper region of a size adapted to accommodate the head of said metal screw with said upper region having a boundary surface contour adapted for coupling engagement with said tool means for rotatably driving said screw so as to permit concurrently rotatably driving both said fastener and screw, and said shank component including on a lower portion thereof an exterior surface contour adapted to provide a plurality of projecting flutes with cutting edges adapted to function as a drill bit upon driving rotation of said fastener.

9. The roof assembly of claim 8 in which said roofing fastener assemblies installed include: the head of said metal screw seated in the upper region of said aperture and the tip of said metal screw anchored in or penetrated through said roof deck; and said plug of resilient compressible insulating material is positioned in said upper region of said aperture and above said head of said metal screw seated in the upper region of said aperture.

10. The roof assembly of claim 9 in which said roofing fastener assemblies installed have said flat upper surface of said head of said roofing fastener flush with or about at the same level as the top surface of said layer of said insulation material and have the self-tapping tip of said metal screw projecting through said roof deck.

11. A roofing fastener for securing thermal insulation material to a roof deck, said fastener comprising:

(a) two components, the first of a synthetic polymeric resinous molded composition and the second of a metal with the second or metal component having its upper portion lodged in the first component and its lower portion projecting from the bottom of the first component;

(b) said first component comprising;

a head, a shank component integrally joined to said head and projecting generally downward from said head.

said head having a generally flat upper surface and a lower smooth surface tapering inwardly from its other edge to a greater thickness at a central region whereat it merges with an upper portion, which projects generally perpendicularly downward, of the shank component, said shank component including on a lower portion thereof an exterior surface contour adapted to provide a plurality of projecting flutes with cutting edges adapted to function as a drill bit upon driving rotation of the fastener, and said head including in or on its generally flat upper surface a means adapted for coupling engagement with a tool means for concurrently rotatably driving said fastener and said second component; and (c) said second component comprising:

its lower portion projecting from the bottom of the first component with the lower portion being a threaded shank with a self-tapping at the end thereof protruding farthermost from the first component.

12. A roof assembly which comprises:

(1) a roof deck;

(2) a layer of insulation material overlying said roof deck;

(3) an exteriorly exposed membrane providing waterproofing of said roof assembly;

(4) a plurality of roofing fastener assemblies installed and securing said layer of insulation material to said roof deck with said assemblies located intermediate said membrane and roof structural members, if present, and with each roofing fastener assembly consisting essentially of (a) a synthetic polymer resinous molded roofing fastener, (b) a metal screw comprised of a threaded shank with a self-tapping tip at one end and at the other end a head adapted for a coupled engagement with a tool means for rotatably driving of said screw, and (c) a plug of resilient compressible insulating material, and with said roofing fastener comprising:

a head, a shank component integrally joined to said head and projecting generally downward from said head, said head having a flat upper surface and a lower smooth surface tapering inwardly from its outer edge to a greater thickness at a central region whereat it merges with an upper portion, which projects generally perpendicularly downward, of the shank component, said fastener including a centrally located aperture extending lengthwise through said shank component and said head with said aperture comprising a lower region of a size adapted to accommodate the threaded shank of said metal screw and comprising an upper region of a size adapted to accommodate the head of said metal screw with said upper region having a boundary surface contour adapted for coupling engagement with said tool means for rotatably driving said screw so as to permit concurrently rotatably driving both said fastener and screw, said shank component including on a lower portion thereof an exterior surface contour adapted to provide a plurality of projecting flutes with cutting edges adapted to function as a drill bit upon driving rotation of said fastener, and with said roofing fastener assemblies installed having the head of said metal screw seated in the upper region of said aperture and the tip of said metal screw anchored in or penetrated through said roof deck and having said plug of resilient compressible insulating material positioned in said upper region of said aperture and above said head of said metal screw seated in the upper region of said aperture; and (5) a layer of wood or of wood composition, which directly underlies said exteriorly exposed membrane and overlies said layer of insulation material, and in which said roofing fastener assemblies installed have said synthetic polymeric resinous molded roofing fasteners thereof with said flat surface of said heads thereof about flush with or about at the same level as the top surface of said layer of wood or wood composition and have the threaded shank of said metal screw extending through the insulation material and the tip of said metal screw screwed into said roof deck or projecting through the bottom of said roof deck.

* * * * *